US005203087A

United States Patent [19]

Richard

[11] Patent Number: 5,203,087

[45] Date of Patent: Apr. 20, 1993

[54] CAN TOP OPENER AND SEALER

[76] Inventor: Walco J. Richard, 9005 Vicksburg, Texas City, Tex. 77591

[21] Appl. No.: 895,647

[22] Filed: Jun. 9, 1992

[51] Int. Cl.[5] ..... B67B 7/46

[52] U.S. Cl. ..... 30/411; 30/446

[58] Field of Search ..... 30/446, 443, 411; 220/693, 315, 322, 323, 227, 228, 231; 215/293; 7/152, 158, 163; 81/3.08, 3.09; D9/438

[56] References Cited

U.S. PATENT DOCUMENTS

| | | | |
|---|---|---|---|
| 676,774 | 6/1901 | Schifferly | 220/323 |
| 868,512 | 10/1907 | Waterbury | 30/411 |
| 952,170 | 3/1910 | Zeese | 30/411 |
| 1,764,648 | 6/1970 | Schaap | 30/411 |

FOREIGN PATENT DOCUMENTS

| | | | |
|---|---|---|---|
| 463375 | 2/1950 | Canada | 30/411 |
| 853265 | 8/1952 | Fed. Rep. of Germany | 30/446 |
| 2148005 | 5/1973 | Fed. Rep. of Germany | 30/446 |
| 991417 | 10/1951 | France | 30/446 |

*Primary Examiner*—Frank T. Yost
*Assistant Examiner*—Hwei-Siu Payer
*Attorney, Agent, or Firm*—S. Michael Bender

[57] ABSTRACT

A punch member is provided sized to span the top of a can. The punch member includes a pair of spaced blades for piercing the can top and after use is adapted to be re-inserted into the pierced holes to provide a seal for the can top. In an alternative embodiment, means are provided for clamping the punch into secure sealing engagement with the pierced can top. In yet still another alternative embodiment, means are provided operative when the can top opener is in sealing engagement with the can top to indicate the level of the can's contents.

5 Claims, 4 Drawing Sheets

CAN TOP OPENER AND SEALER

BACKGROUND OF THE INVENTION

1. Field of the Invention

The present invention relates generally to can opening devices, and more particularly, to a reusable can top opener capable of sealingly engaging the pierced holes in the can top.

2. Description of the Prior Art

Devices for opening an aluminum or steel can having a sealed end or top (e.g. a beer can) are well known. The familiar "church key" comprises a simple lever arm terminating in a sharply pointed tip and a catch for engaging the can's rim. Rotation of the lever arm about the pivot defined by the catch punctures holes in the can top whereupon the contents may be poured. In the case of this well known device, however, the can top cannot be sealed after initial use and while there still remain contents in the can container without using separate sealing means.

In another class of can opener, the can top is provided with a self-contained tab or removable section which may be peeled away from the remainder of the can top leaving suitable openings therein. Examples of such arrangements are disclosed in U.S. Pat. Nos. 3,434,622; 3,435,977; 3,441,169; 4,200,198; and U.S. Pat. No. 305,734. Here again however, once the tab or removable section is severed from the can top, separate means must be employed if it is desired to seal the can with a portion of its original contents still remaining therein.

SUMMARY OF THE INVENTION

Against the foregoing background of prior art, it is apparent that a need exits for a can top opener capable of sealing the holes in the can top to help preserve or protect any of the contents remaining in the can after initial use. This need is met by the present invention which briefly described comprises an opener for sealed metal cans in the form of a plate member sized to span the diameter of the can's top or end and from which depends a pair of piercing blades. The plate member is positioned on the can top and by applying weight pressure via the palm of the hand the plate member is caused to move downwardly against the can top with the piercing blades thereby forming a corresponding pair of holes in the can top. After initial use, and while a portion of the can's original contents remains, the plate member may be re-inserted on top of the can with the blades thereof being placed in the pierced holes in sealing engagement therewith.

In an alternative embodiment, a pair of pivotal clamp members are provided at the opposed ends of the plate member respectively, activatable to secure the plate in its sealing engagement atop the can.

In yet still another alternative embodiment, means are provided for forming an additional perforation in the can top and level indicator means are further provided accessible to the interior of the can through the additional hole to indicate the relative volume of the contents remaining in the can after the plate member has been secured atop the can in sealing engagement therewith.

The above brief description sets forth rather broadly the more important features of the present invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least three embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention of the application, which only is measured by the claims, nor is it intended to be limiting as to the scope of the invention in any way.

It is therefore an object of the present invention to provide a new and improved can top opener and sealer which has all the advantages of the prior art and none of the disadvantages thereof.

It is another object of the present invention to provide a new and improved can top opener and sealer which may be easily and efficiently manufactured and marketed.

It is a further object of the present invention to provide a new and improved can top opener and sealer which is of a durable and reliable construction.

An even further object of the present invention is to provide a new and improved can top opener and sealer which is susceptible of a low cost of manufacture with regard to both materials and labor, and which accordingly is then susceptible of low prices of sale to the consuming public, thereby making such can top opener and sealer economically available to the buying public.

Still yet another object of the present invention is to provide a new and improved can top opener and sealer which provides in the apparatuses and methods of the prior art some of the advantages thereof, while simultaneously overcoming some of the disadvantages normally associated therewith.

Still another object of the present invention is to provide a new and improved can top opener and sealer having means for securing the opener in sealing engagement with a can top after initial use and while a portion of the original contents of the can still remains therein.

It is yet still another object of the present invention to provide a new and improved can top opener and sealer capable of indicating the relative volume of the contents remaining in the can after initial use.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had now to the accompanying drawings and descriptive matter in which there are illustrated preferred embodiments of the invention.

BRIEF DESCRIPTION OF THE DRAWINGS

The invention will be better understood and the above objects as well as objects other than those set forth above, will become apparent when consideration is given to the following detailed description thereof. Such description makes reference to the annexed drawings wherein.

DESCRIPTION OF THE PREFERRED EMBODIMENT

Figure 1:
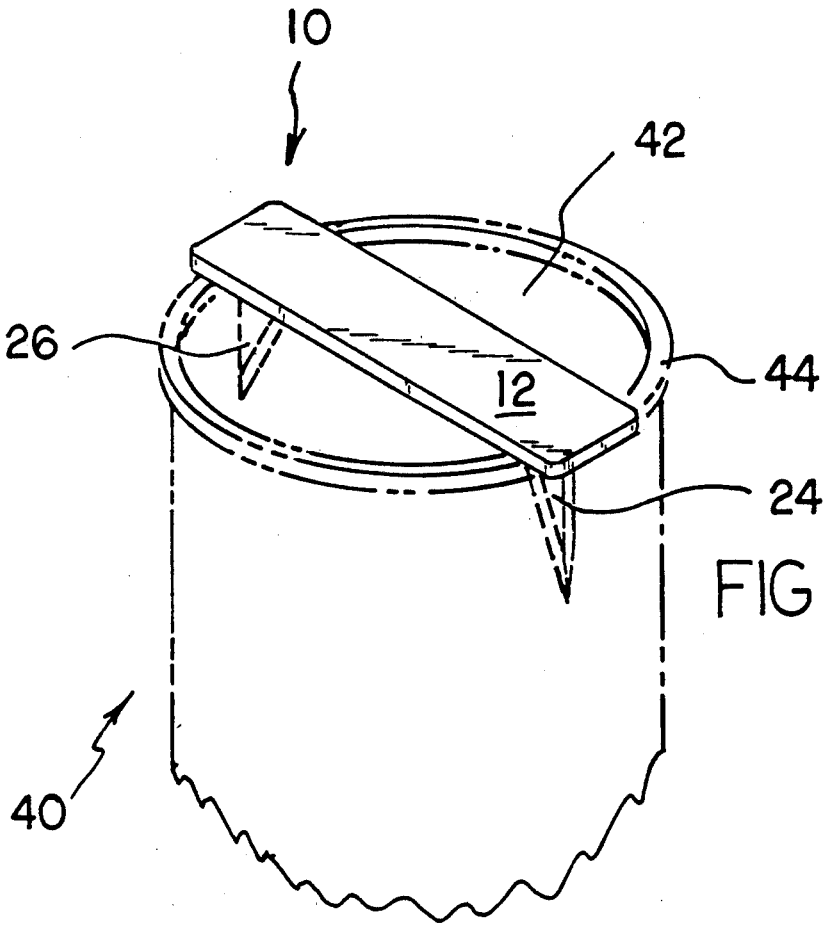
FIG. 1 is a perspective view in elevation showing the present invention in use atop a can.
Figure 2:
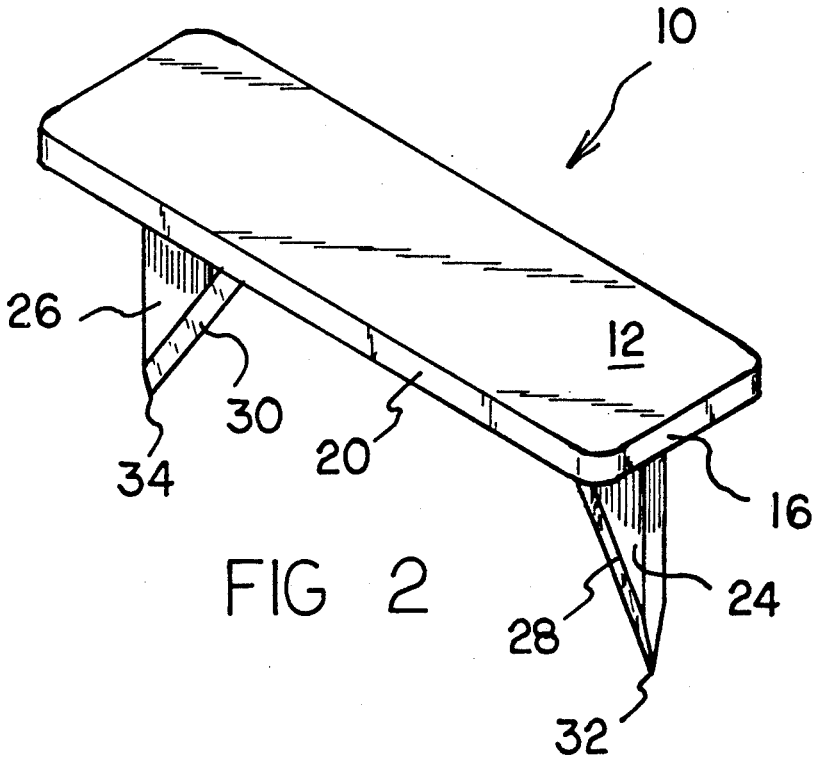
FIG. 2 is a perspective view in elevation of the can top opener and sealer according to the present invention.
Figure 3:
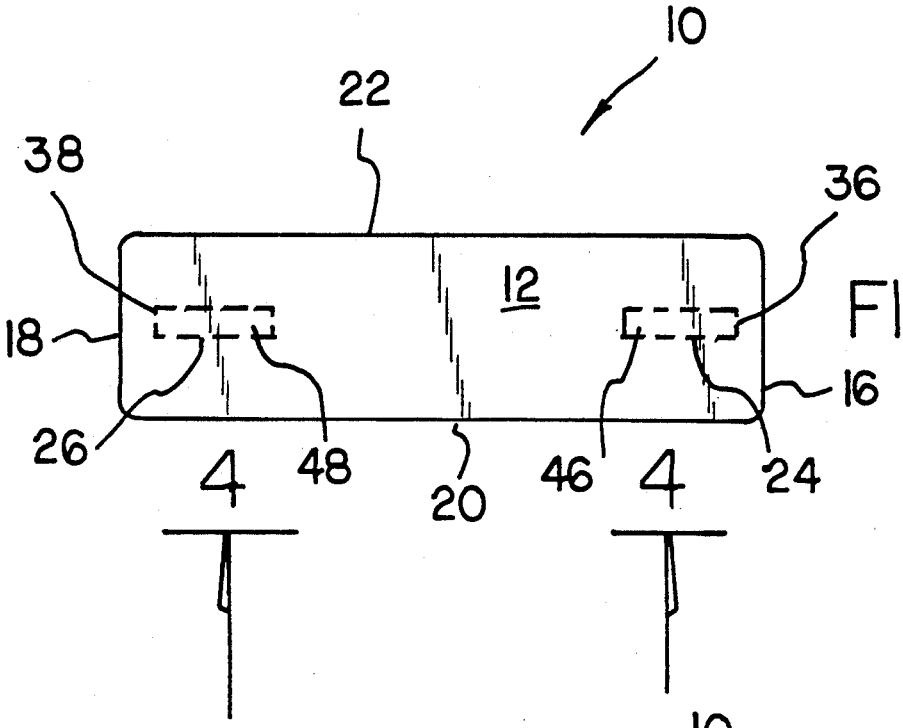
FIG. 3 is a top plan view of the invention shown in FIG. 2.
Figure 4:
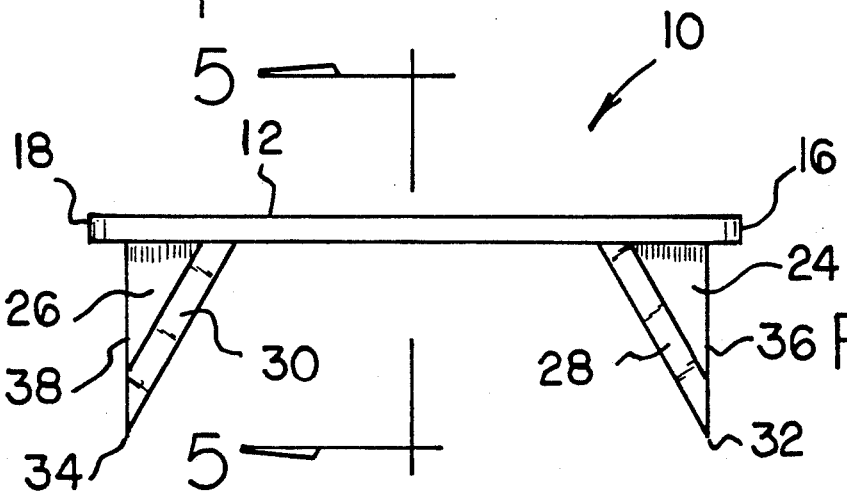
FIG. 4 is an elevational view of the invention shown in FIG. 2.
Figure 5:
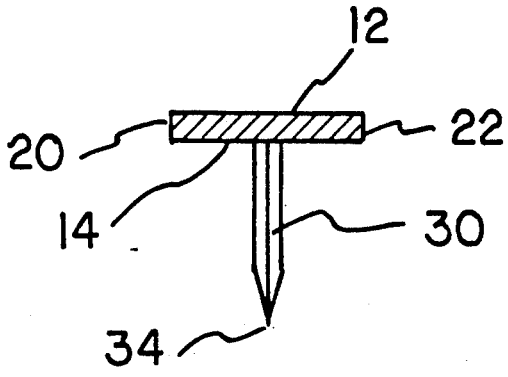
FIG. 5 is a cross-sectional view in elevation taken along line 5—5 of FIG. 4.

With reference now to the drawings, a new and improved can top opener and sealer embodying the principles and concepts of the present invention will be described.

Turning initially to FIGS. 1–5, a first preferred embodiment of the present invention is shown comprising a flat plate or punch member 10 of generally rectangular shape having a top surface 12, a bottom surface 14, opposed end edges 16, 18, and opposed side edges 20,22. Integrally attached to plate member 10 on the bottom surface 14 thereof in a suitable manner is a pair of downwardly depending blade members 24,26 each of which has a beveled cutting or knife edge 28,30 terminating in a sharp puncturing point 32,34 at the distal end thereof substantially as shown. Each knife edge 28,30 faces inwardly toward each other as shown and makes approximately a 45° angle with a straight flat outwardly facing edge 36,38. In addition, each blade outwardly facing edge 36,38 is positioned slightly inwardly from corresponding end edges 16,18 the purpose of which will be made apparent below.

In use, the plate member 10 is positioned on the sealed end or top 42 of an aluminum or steel can 40 (FIG. 1) and with the weight of the palm bearing against upper surface 12, the plate member is urged in the downward direction so that knife blade points 32,34 puncture the top 42. Because of the wedge shape of each blade member 24,26 and the sharpness of beveled knife edges 28,30 further downward pressure on plate member top surface 12 causes the flat plate to come to rest against the rim 44 of the can top with the bottom surface 14 engaging the rim in the spaces provided by offsetting the flat outer edges 36,38 of each blade inwardly with respect to plate end edges 16,18 as described above. By this same action, knife edges 28,30 form perforations in the can top permitting the contents of the can to be poured therefrom upon subsequent removal of the plate member. The size of the perforations thus formed in the can top will approximate the maximum cross-sectional shape of each blade member which latter is indicated by the broken-line rectangles 46,48 in FIG. 3. After pouring a portion of the contents from the can, the plate member 10 may be placed on the top of the can with the blade members seated within the perforations originally formed thereby (i.e. the position shown in FIG. 1) to sealingly engage the can and thus provide in accordance with the invention, an effective means for sealing the opened can and preserving the contents therein from spoilage, spillage, or the like. This advantageously facilitates storage of the can as in a refrigerator, for example, for use at a later time.

It will be appreciated that the size of the plate member or punch 10 will depend upon the size of the can with which it is to be used. Generally speaking, the longitudinal dimension of the plate member will be equal to or slightly greater than the outside diameter of the can, and the blade members will be spaced apart sufficiently to form the perforations proximal to the inside of the rim on the can's top or end.

For safety sake, the plate member 10 when not in use may be housed within a protective guard member (not shown) having a pair of perforations substantially the same size and shape as blade members 24,26 as will occur to those of ordinary skill.

Figure 6:
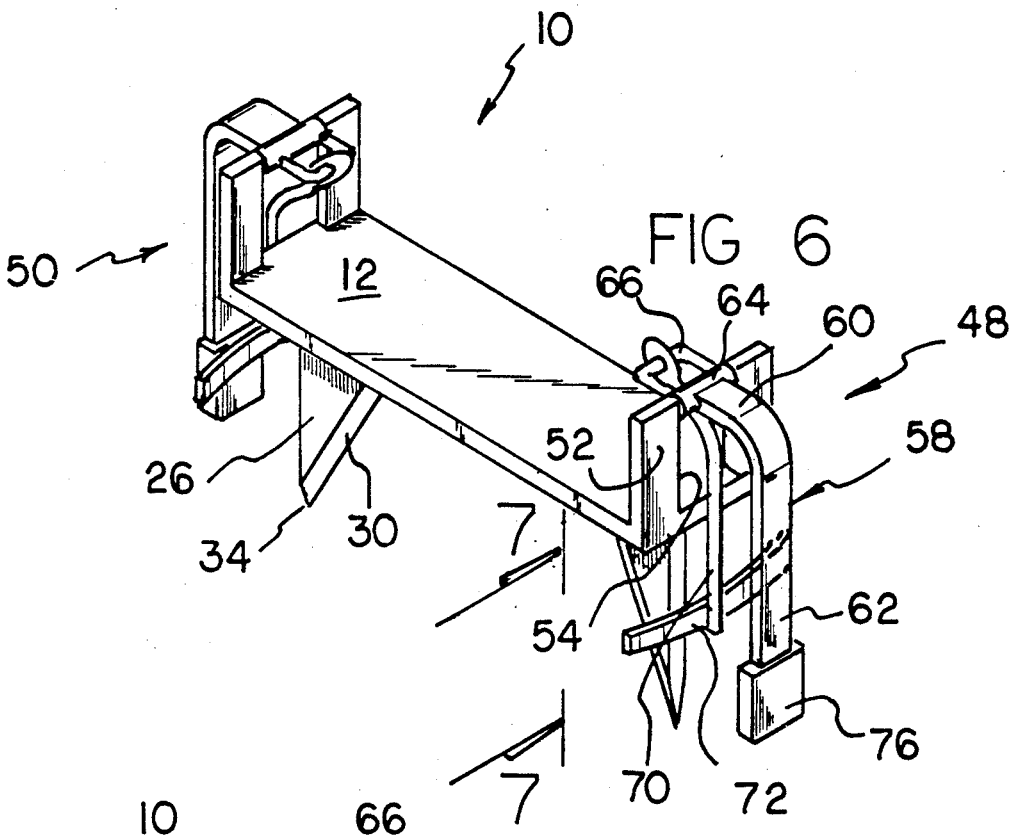
FIG. 6 is a perspective view in elevation of an alternative embodiment of the invention.
Figure 7:
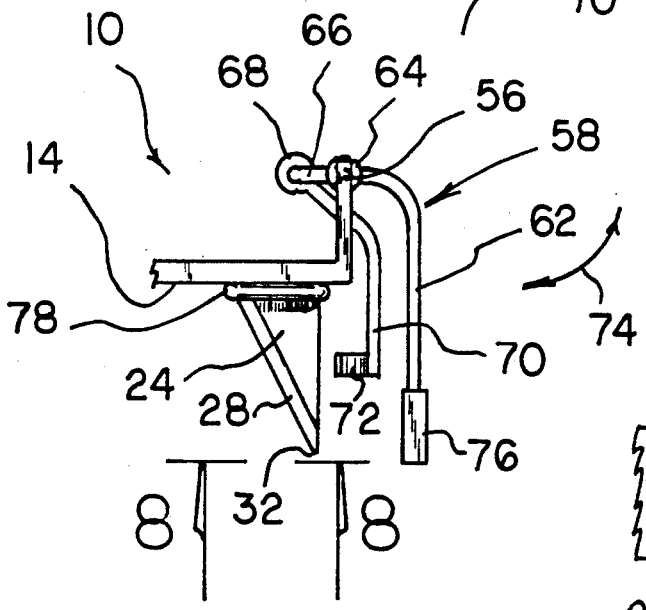
FIG. 7 is an elevational view of a portion of the invention shown in FIG. 6 taken along line 6—6.
Figure 8:
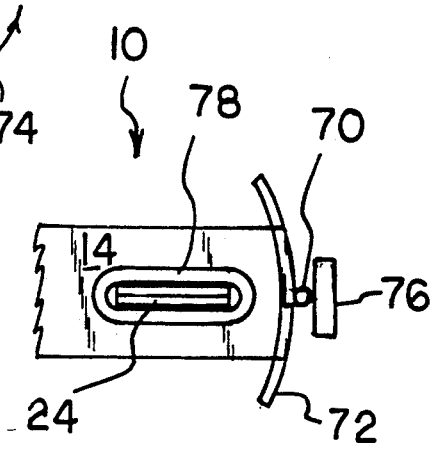
FIG. 8 is a bottom plan view of the portion of the alternative embodiment shown in FIG. 7 taken along line 8—8 thereof.

In the event a more secure seal is desired between the can top opener of the present invention and the can with which it has already been used to form openings or perforation therein, the alternative preferred embodiment of FIGS. 6 through 8 may be employed. Thus, turning now to the latter figures, where like reference numerals denote similar parts already described, there is shown a pair of clamping assemblies 48,50 at either opposed end thereof. The clamping assemblies 48,50 are identical, hence, a description of one will suffice for both.

Each clamping assembly comprises an upstanding support member 52 integrally formed at the end of plate member 10 substantially as shown and includes a central rectangular cut-out or recess 54 which recess defines an axle 56 spanning the upper extremity of support member 52. A crank arm 58 is provided having a right angle bend therein to define an upper section 60 and a lower section 62. Upper section 60, in turn, is integrally joined to a tubular bushing 64 which has extending therefrom a U-shaped loop member 66. The crank arm bushing 64 is suitably supported for rotation about an axis defined by axle 56 and thus both the crank arm and the U-shaped loop 66 are rotatable about this axis. Suitably coupled to the outermost arm of the U-shaped loop member via an eyelet 68 is a transfer arm 70 which extends at an angle through central opening 54 thence downwardly in the direction of lower section 62 of the crank arm 58 substantially as shown. Transfer arm 70 at its other end opposite eyelet 68 is integrally joined in a suitable manner to a curved clamping jaw 72 extending laterally to either side thereof. By this arrangement, when crank arm 58 is caused to rotate about axle 56 in a clockwise direction (arrow 74, FIG. 7), clamping jaw member 72 will be urged toward the left as viewed in FIG. 7. To facilitate such rotation, the distal end of lower section 62 of the crank arm is suitably provided with a finger tab 76.

In use, the alternative embodiment of FIGS. 6–7 is employed as before. However, as the plate member 10 moves into engagement with the rim of the can being opened (and then sealed), the side of the can will urge clamping jaw 72 outwardly therefrom (to the right as viewed in FIG. 7) causing the crank arm to rotate counterclockwise. Pressure against finger tab 76 to the left, i.e. in the clockwise direction, will then cause the clamping jaw to engage the side of the can and the crank arm will snap into place in the position shown in FIG. 7 providing a secure grip between the clamping jaw and the can sufficient to securely maintain the plate member 10 in sealing engagement with the can with the blade members seated within the perforations previously formed in the can. To release this engagement, all that is necessary is to rotate the crank arm to the right (counterclockwise as viewed in FIG. 7) via finger tab 76 and the clamping jaw member 72 will disengage permitting easy removal of plate member 10.

In order to provide an even more effective seal of the perforations formed in the can top when using the present invention, a resilient O-ring seal 78 may be suitably fixed to undersurface 14 surrounding the base of each blade member 24,26 substantially as shown in FIGS. 7 and 8.

Figure 9:
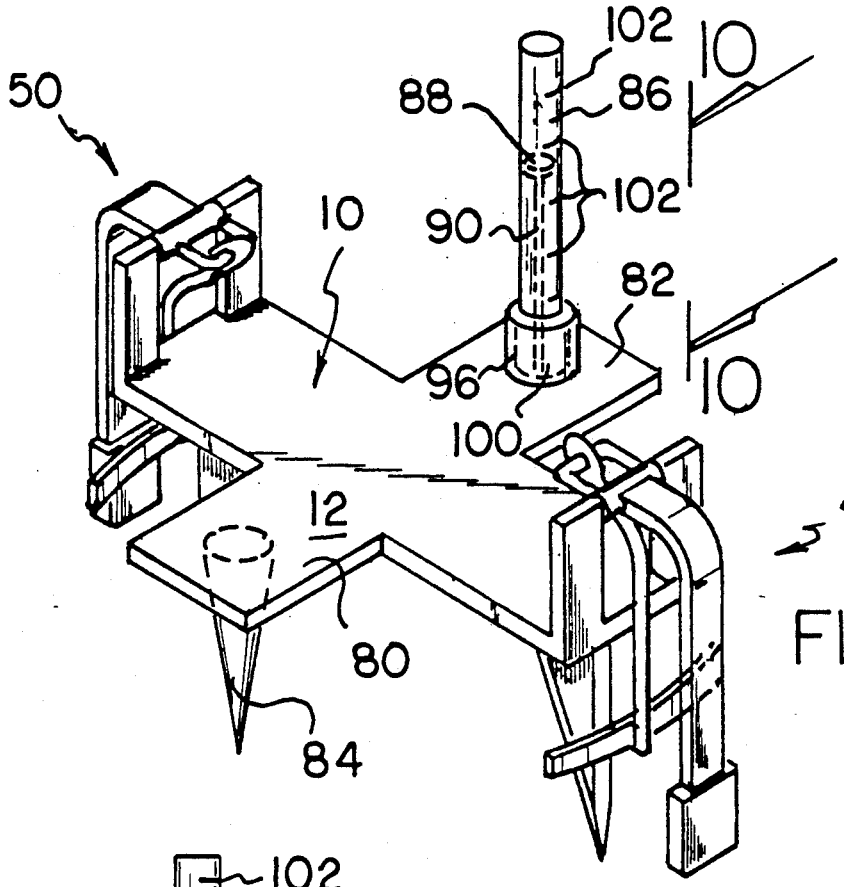
FIG. 9 is a perspective view in elevation of yet another alternative embodiment of the invention.
Figure 10:
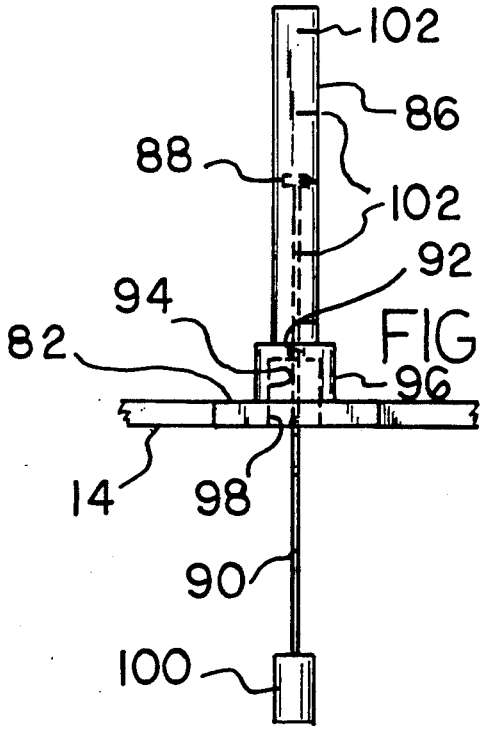
FIG. 10 is a partial view in elevation of the embodiment of FIG. 9 taken along line 10—10 thereof.

Turning now to FIGS. 9 and 10 there is shown yet still another alternative embodiment of the present invention wherein plate member 10 further includes a pair of right angle extensions 80,82 whereby the shape of the plate member is that of a cruciform substantially as depicted with the longitudinal dimension of extension 80,82 being substantially the same as the longitudinal dimension of plate member 10. Downwardly depending from the underside of extension 80 is a conical punch member 84 adapted to form a round shaped perforation in top of the can being opened when the plate member 10 is employed as before to open the sealed top or end of a can. Located in extension 82, the same distance from the central axis (not shown) of plate member 10 as conical punch 84 is a hollow "level indicator" tube 86 of transparent material; preferably plastic or the like. An indicator 88 visible through the tube wall is supported on a thin connecting rod 90 which latter extends through a narrow opening 92 between the interior of the tube 86 and an enlarged cylindrical opening 94 in the base 96 upon which tube 86 is supported. Opening 94, in turn, communicates with a similar sized opening 98 in extension 82. Connecting rod 90 is attached at its opposite end to a float member 100 of suitable buoyant material. The diameter of float member is slightly less than the diameter of the hole formed by conical punch 84. Indicator 88 thus will slide up or down within tube 86 as float member 100 and connecting rod 90 slide up or down. Disposed on tube 86 is a series of equally spaced indicator markings 102 which may be calibrated to indicate the level of the fluid remaining inside can 40 as will be further explained.

In use, the plate member 10 is used as described above to form a pair of sealable perforations in the top 42 of can 40. However, at the same time a round hole will also be formed therein via conical punch 84. When the alternative exemplary embodiment of FIGS. 9 and 10 is ready for use to seal an already opened can still retaining a portion of its contents, the plate member 10 is rotated 180° degrees before being replaced on the can top and sealed thereagainst via the action of clamping assemblies 48,50. When this is done, the float member 100, connecting rod 90, and indicator 88 will fall under the influence of gravity through openings 92 and 98 and into the interior of can 40. The falling float member and therefore the indicator 88 will come to rest depending upon the amount of contents still remaining in the can. The indicator marks 102 on tube 86 will thus indicate the relative volume of contents still remaining in the can. Preferably, these marks are used to represent FULL, ¾ FULL, ½ FULL, ¼ FULL, but any other convention may be used instead.

Finally, it will be noted that after the plate member 10 is rotated 180° to place the indicator tube 86, indicator 88, connecting rod 90, and float 100 in alignment with the hole formed by the conical punch 84, and the device used to seal the can 40, a second conical hole, 180° out of phase with the first conical hole will be formed in the can top. Thereafter, less care need be taken to rotate the plate member 10 before sealing emplacement because the necessary hole or perforation in the top 42 of can 40 will be present in the can top under both extensions 80 and 82.

In summary, there has been fully described above a new and improved can top opener and sealer having means for securely clamping the opener to a previously opened can and effectively sealing same. In addition, novel level indicator means are provided enabling the user to discern at a glance the level of or relative volume of the contents remaining in the previously opened, sealed container.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing form the principles and concepts set forth. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved opener for a container having a sealed end comprising:

a plate member having a longitudinal dimension at least as large as the longitudinal dimension of said container's sealed end, a pair of blade members adapted to pierce said sealed end and form corresponding openings therein, said blade members being fixed to said plate member at locations wherein the distance between said blade members is less than the longitudinal dimension of said plate member, said opener further comprising means on said plate member cooperating with an additional opening in said container end for indicating the level of the contents remaining in said container after said corresponding openings have been formed therein and a portion of said contents has been dispensed from said container, said means for indicating including means for forming said additional opening in said container end.

2. The opener of claim 1 wherein said means for forming said additional opening comprises a punch member located on said plate member and spaced from said blade members.

3. The opener of claim 2 wherein said means for indicating includes a second additional opening in said plate member spaced from said blade members and said additional opening, a hollow tube having an open end mounted on said plate member in alignment with said second additional opening, a float member in said hollow tube, an indicator member for movement up and down in said hollow tube, a connecting rod connected between said float member and said indicator member, said hollow tube being transparent whereby said indicator is visible through said transparent hollow tube, said float member being sized to pass through said second additional opening when said plate member is disposed on said container end.

4. The opener of claim 3 wherein said plate member is in the shape of a cruciform having four leg sections defining first and second pairs of opposed leg sections orthogonally related to each other, said blade members being located on said first pair of leg sections in an opposed relationship, and said punch member and said hollow tube being located on a second pair of said leg sections in an opposed relationship.

5. A new and improved opener for a container having a sealed end comprising:

a plate member having a longitudinal dimension at least as large as the longitudinal dimension of said container's sealed end, a pair of blade members adapted to pierce said sealed end and form corresponding openings therein, said blade members being fixed to said plate member at locations wherein the distance between said blade members is less than the longitudinal dimension of said plate member, wherein said plate member has a pair of opposed ends defining the limits of said longitudinal dimension, clamping means supported on at least one of said opposed ends to clamp said plate member to said container with said blade members being seated within the openings formed thereby in said sealed end of said container, and wherein said clamping means comprises a support member on said one opposed end, said support member defining an axle about which a clamping arm may be rotated, said axle located intermediately opposed ends of said clamping arm, jaw means attached to one end of said clamping arm whereby rotation of the other end of said clamping arm about said axle is effective to cause said jaw means to engage a side of said container when said plate member is positioned on said container sealed end with said blade members received in said openings formed thereby.

* * * * *